US010851807B1

(12) United States Patent
Bassi et al.

(10) Patent No.: US 10,851,807 B1
(45) Date of Patent: Dec. 1, 2020

(54) ENERGY GENERATING SYSTEM USING FLOOR TILES AND FLUID/GAS MOVEMENT

(71) Applicant: King Abdulaziz University, Jeddah (SA)

(72) Inventors: Hussain Bassi, Jeddah (SA); Abdulhameed F. Alkhateeb, Jeddah (SA)

(73) Assignee: King Abdulaziz University, Jeddah (SA)

( * ) Notice: Subject to any disclaimer, the term of this patent is extended or adjusted under 35 U.S.C. 154(b) by 0 days.

(21) Appl. No.: 16/721,043

(22) Filed: Dec. 19, 2019

(51) Int. Cl.
*F15B 7/00* (2006.01)
*E04B 5/02* (2006.01)

(52) U.S. Cl.
CPC ..... *F15B 7/003* (2013.01); *E04B 5/02* (2013.01); *F15B 2211/7058* (2013.01)

(58) Field of Classification Search
CPC ..... F03G 5/06; F03G 7/08
See application file for complete search history.

(56) References Cited

U.S. PATENT DOCUMENTS 3,865,507 A * 2/1975 Lesokhin ..... F03B 3/12 416/1
2002/0145350 A1 10/2002 Henderson et al.
2004/0182099 A1* 9/2004 Hsu ..... H01L 23/473 62/259.2
2007/0085342 A1* 4/2007 Horianopoulos ..... F03G 7/08 290/1 R
2007/0157615 A1* 7/2007 Morgenstein ..... H02K 44/08 60/645

(Continued)

FOREIGN PATENT DOCUMENTS

AU 2018100812 A4 7/2018
CN 201963310 U * 9/2011 ..... F16H 1/46

(Continued)

OTHER PUBLICATIONS

Iqbal Mahmud, "Electrical Power Generation Using Footsteps", European Scientific Journal, vol. 14, No. 21, Jul. 2018, pp. 318-328.

(Continued)

*Primary Examiner* — Abiy Teka
*Assistant Examiner* — Matthew Wiblin
(74) *Attorney, Agent, or Firm* — Oblon, McClelland, Maier & Neustadt, L.L.P.

(57) ABSTRACT

An energy generating system that utilizes a movement of a fluid/gas includes a plurality of floor tiles, a fluid/gas, and a power generating unit. Preferably, the plurality of floor tiles is layered across an area with high foot traffic. The fluid/gas is confined in a fluid tank positioned underneath the plurality of floor tiles such that a pressure applied on the plurality of floor tiles is transferred onto the fluid/gas, and generates movement in the fluid/gas. The movement allows the fluid/gas to flow towards a plurality of turbines of the power generating unit through a piping network and a plenum passage, and rotate the plurality of turbines. The rotational movement of the turbines is converted into electrical energy by a generator of the power generating unit. The electrical output of the generator is stored in a battery bank.

20 Claims, 8 Drawing Sheets

(56) References Cited

U.S. PATENT DOCUMENTS

| | | | | |
|---|---|---|---|---|
| 2007/0246940 | A1* | 10/2007 | Fajardo Valon | F03G 7/08 290/1 R |
| 2008/0224477 | A1* | 9/2008 | Kenney | F03G 7/08 290/1 R |
| 2012/0146340 | A1* | 6/2012 | Burke | F03G 7/08 290/1 R |
| 2014/0145550 | A1 | 5/2014 | Hitchcock et al. | |
| 2015/0361967 | A1* | 12/2015 | Gallelli | F01D 15/10 60/530 |
| 2016/0053441 | A1* | 2/2016 | Farahat | F03G 7/08 137/565.01 |
| 2017/0012495 | A1* | 1/2017 | Pradel | B60G 13/14 |
| 2018/0342929 | A1* | 11/2018 | Webster | E04F 15/02 |
| 2019/0035957 | A1* | 1/2019 | Pujari | H02S 10/10 |
| 2019/0044413 | A1* | 2/2019 | Mokoenene | H02K 7/1823 |

FOREIGN PATENT DOCUMENTS

| | | | |
|---|---|---|---|
| CN | 102324871 | A | 1/2012 |
| CN | 202435307 | U | 9/2012 |
| CN | 202989725 | U | 6/2013 |
| CN | 103307544 | A | 9/2013 |
| CN | 203602981 | U | 5/2014 |
| CN | 203654673 | U | 6/2014 |
| CN | 204139530 | U | 2/2015 |
| CN | 105595777 | A | 5/2016 |
| GB | 2473198 | A | 3/2011 |
| KR | 10-0622830 | B1 | 9/2006 |
| KR | 10-0977766 | B1 | 8/2010 |
| KR | 10-1029297 | B1 | 4/2011 |
| WO | WO 2008/082458 | A2 | 7/2008 |
| WO | WO 2008/082458 | A3 | 7/2008 |
| WO | WO 2012/080636 | A1 | 6/2012 |

OTHER PUBLICATIONS

"The Hydro and Wind Company Securing a clean energy future, profitably", Renewables, https://renewablesfirst.co.uk/hydropower/hydropower-learning-centre/how-much-power-could-i-generate-from-a-hydro-turbine/, Dec. 19, 2019, 8 pages.

* cited by examiner

ENERGY GENERATING SYSTEM USING FLOOR TILES AND FLUID/GAS MOVEMENT

BACKGROUND

Field of the Invention

The present disclosure relates to a method of utilizing energy from a flow of a fluid and/or gas generated by pressure applied on floor tiles. The flow of the fluid and/or gas is used to operate a power system that generates electrical energy as an output.

Description of the Related Art

Harnessing energy from pedestrians using energy harnessing floor panels is a widely studied topic. A majority of the studies and prior art in the field of study is based upon the piezoelectric effect, where certain materials have the ability to generate an electric charge in response to applied mechanical stress.

Electrical energy can be produced by converting mechanical energy generated from footsteps. Mahmud, I., Electrical Power Generation Using Footsteps. European Scientific Journal, ESJ, 14(21), 318 (2018)—incorporated herein by reference in its entirety. A system that can simulate the process of generating electrical energy using footsteps comprises a pipe, a nozzle, a unidirectional valve, a water reservoir, a turbine, and a direct current (DC) motor. When pressure is exerted on the reservoir, water flows through the nozzle and into the turbine to generate electrical energy which is stored in the battery. The Mahmud system is intended to reduce global warming and load shedding, where load shedding is an interruption of an electric supply to avoid excessive load on the generating plant, in a cost-effective manner. This system is related to human activity and the weight of the setup is crucial.

CN204139530U—incorporated herein by reference in its entirety. The power generation floor of the CN204139530U disclosure comprises a power generation unit and a floor shell unit. A base block and a spring supporting frame of each power generation unit are fixedly connected to a box body, and an impact bar penetrates a through hole in the box body and a through hole in the corresponding spring supporting frame. A spring is arranged on the periphery of each impact bar in a sleeving mode in a compressed state. Bolts penetrate the through holes in each base block, and through holes in a corresponding middle fixing block. The opposite ends of the bolts are connected with nuts. The roots of four piezoelectric cantilever beams can be clamped among an upper fixing block, the corresponding middle fixing block and a lower fixing block through the connection of the corresponding bolts and corresponding nuts. Mass blocks are fixed to the ends of piezoelectric cantilever beams. A cover plate and a base of the floor shell are connected with holes through columns, wherein the columns of the base are sleeved with springs. The bottom end of the springs press the bottoms of the holes in a periphery of the base. The power generating units are distributed in the base in an array mode and the associated wires are arranged within the base.

CN102324871A—describes using a piezoelectric type energy harvesting unit formed by a piezoelectric vibrator in a supported beam structure. The piezoelectric type energy harvesting unit and a load circuit are serially connected to form a power supply unit, wherein the power supply unit is installed in structures such as bridges and buildings. The vibration energy from the environment can be harvested to supply power for a wireless sensor node that monitors for fatigue status in buildings and mechanical equipment. A plurality of piezoelectric type energy harvesting units are combined to form a piezoelectric type energy harvesting module, wherein the piezoelectric type energy harvesting module can be laid in rooms, subway stations or squares with dense people such that energy generated by walking can be converted into electrical energy. The piezoelectric type energy harvesting module can be directly laid under concrete of pavements, railways or airports to convert vibration energy of road surfaces into electrical energy.

CN203602981U—discloses a power generating floor board comprising a cover plate, a base, a plurality of piezoelectric sheets, a circuit board, a seal gasket, and a seal frame. The base is provided with a plurality of piezoelectric sheet supporting units and an electric conductive groove. The circuit board is arranged in the electric conducting groove. The piezoelectric sheets are fixed on support units by a simple supporting mode and force transmitting bodies are arranged at intervals on the bottom surface of the cover plate. The seal gasket is provided with counter bore holes adaptive to the force transmitting bodies. The bottom surface of the seal gasket is provided with bulges corresponding to the counter bore holes, wherein the bulges are in contact with the piezoelectric sheets. The seal gasket is fixedly connected with the base and the piezoelectric sheets are connected with the circuit board by leads. The periphery of the base is connected with the cover plate by a seal frame.

CN203654673U—describes a system comprising a base portion, a mechanical transmission portion, and an energy collection portion. Mechanical energy generated by treading of people or vehicle movement is transmitted to the energy collection portion by the mechanical transmission portion. An energy collection portion comprising a piezoelectric cantilever beam structure, converts the mechanical energy into electrical energy. When the energy collection efficiency is high, the collected electric energy can supply power for devices such as a sensor and a light-emitting diode (LED).

WO2012080636A1—describes an electrical energy generating floor element comprising a rigid board, a piezoelectric energy generator located underneath the rigid board, and an actuating member located underneath the rigid board to support the rigid board and transmit pressure exerted on the rigid board. A force reducing device is arranged under the rigid board. The actuating member is coupled with the piezoelectric energy generator to stress the piezoelectric energy generator with a pressure that is reduced relative to the pressure exerted on the rigid board. A base, which is intended to be positioned on the floor along with the piezoelectric generator, the actuator supporting the rigid board, and the force-reducing device is used in gathering the electric energy generated by the piezoelectric energy generator in response to the pressure.

A majority of conventional electricity-generating floor tiles utilize the piezoelectric effect. A disadvantage with this approach is that a boundary effect between adjacent tiles is not considered in the energy generating process. More specifically, a pressure sensed at a boundary condition may not be translated into sufficient movement that can result in generating energy.

WO2008082458A3—describes an energy generator comprising a generally flat and partially flexible traffic surface on which pedestrians and traffic may pass. Underneath the traffic surface a plurality of dynamo cells is positioned, wherein the plurality of dynamo cells comprises a dynamo, two electricity generating elements, which can be magnets and coils, and an operative electrical connection to an electrical load such as a battery, capacitor, or an electrical network. A first electrical energy generating element in each dynamo may be disposed such that the energy generating element moves downwards when the weight from traffic is applied to the traffic surface. A second electrical energy generating element remains stationary supported by the bottom surface of the energy generator. A spring and bottom support may urge the first (moving) element back upwards when the imposed force is released.

US20140145550A1—describes an energy conversion apparatus configured to convert energy from a mechanical energy source into electrical energy. The energy conversion apparatus includes a transducer comprising a dielectric elastomer module made of stretchable electroactive polymer material. The dielectric elastomer module comprising at least one dielectric elastomer film layer is disposed between at least first and second electrodes. A transmission coupling mechanism is configured to couple the mechanical energy source and is operatively attached to the transducer to cyclically strain and relax the transducer in response to the mechanical energy acting on the transmission coupling mechanism. A conditioning circuit is coupled to the at least first and second electrodes and configured to apply an electric charge to the dielectric elastomer film when the dielectric elastomer film is in a strained state, to disconnect from the dielectric elastomer film when the dielectric elastomer film transitions from the strained state to a relaxed state, and to remove electrical charge from the dielectric elastomer film when the dielectric elastomer film reaches a relaxed state.

US20020145350A1—describes a pressure to electric converter (PEC) utility device designed to convert intermittent pressure into electrical charges. The PEC may be implemented in a variety of forms. One such form is the mechanical floor plate which includes a set of depressible track mounted plates with small barrel electrical generators attached to a bottom surface. The electrical generators are used to convert the downward step pressure into rotational energy for the generators. The implementation is inexpensive to manufacture, as it uses off the shelf components, and would be ideal in third world applications where components are difficult to obtain. The implementation would be useful in animal movement applications such as the herding of livestock for transport or processing. The generated electrical energy is stored in a battery assembly, and the flooring is designed to be locked together on each side. Electrical transport channel outlets are made available as well. A piezoelectric implementation with piezoelectric film or ceramics in conjunction with relevant design considerations is an option to provide comfortable stepping and also to avoid accidental tripping.

KR100977766B1—describes using a load on a stair to generate electric energy. To do so, the power generating device includes a movable plate, a rotation axis, a stopper, a pressure protrusion, a cylinder, a piezoelectric element, a spring, and a current collector. The movable plate is formed by cutting horizontal steps in a longitudinal direction. The rotation axis axially fixes the longitudinal center of the movable plate to both sides of the horizontal step. The stopper protrudes from a bottom of the vertical plate to receive one end of the movable plate. The pressure protrusion is fixed at the bottom of an opposite side of the movable plate. The cylinder is formed by inserting the pressure protrusion. The piezoelectric element is installed along an internal surface at the bottom of the cylinder. The spring is attached externally along an outer circumference of the pressure protrusion. The current collector is connected to a lead line drawn from the piezoelectric element.

KR100622830B1—describes a small-sized electric generator piezoelectric device that uses kinetic energy to generate electric energy which can be used by an external electronic device.

CN202435307U—describes a power generation module that comprises a pressure plate and a plurality of pressure power generation units that are operatively coupled to each other. Each of the plurality of power generating units comprises a plurality of upper piezoelectric layer arranged in elastic plates. The ends of the elastic plates are embedded into a soft support part which is positioned outside the elastic plates, and the surface of each of the upper piezoelectric layers is provided with a metal coating. Each piezoelectric layer comprises at least two small piezoelectric columns, and resin layers are filled into the small piezoelectric columns. The pressure power generation units are vertically stacked, each two adjacent pressure power generation units are connected through an intermediate section. An upper end of each intermediate section is connected with the elastic plate of the pressure power generation unit above the intermediate section. Mechanical energy generated during walking is collected to be converted into electric energy is directly supplied to lighting appliances, and thereby power consumed by public places or commercial buildings can be effectively saved.

KR101029297B1—relates to a piezoelectric layer formed on at least one surface of an elastic substrate and a cushioning layer formed on both sides of the elastic substrate. The KR101029297B1 disclosure relates to a piezoelectric generator system including at least one rectifying circuit unit for converting to a power source and an elastic mat unit covering the piezoelectric generator unit.

In view of the difficulties and drawbacks of existing energy generating systems, the present disclosure describes a system that utilizes surface pressure, e.g., generated by the footsteps of pedestrians, to move a fluid and/or a gas. The fluid/gas movement is used to rotate a fan or a turbine of a power system that generates electrical energy. In contrast to the unidirectional movement used in conventional energy generating systems, the present disclosure describes the use of the bidirectional movement of fluid/gas to generate electric energy.

SUMMARY OF THE INVENTION

The present disclosure describes an energy generating system that utilizes movement of a fluid/gas to generate electric energy. The movement of the fluid/gas is created by a pressure applied at a plurality of floor tiles. More specifically, when pedestrians step on the plurality of floor tiles, a pressure applied in a vertical direction moves the fluid/gas that is confined underneath the plurality of floor tiles. The fluid/gas is then used to rotate a plurality of turbines of a power generating unit which produces electrical energy as an output. With each step landing on the plurality of floor tiles, a downward pressure is applied on the fluid/gas creating movement in the fluid/gas. When the foot is released from contacting the plurality of floor tiles, the pressure is released from the fluid/gas creating movement in the fluid/gas. The power generating unit of the present disclosure is configured to utilize the movement occurring in the fluid/gas when a tile moves in a downward direction as well as in an upward direction. The generated electrical energy will be stored in a battery bank. The plurality of floor tiles is modular and thus, pressure is applied on the fluid/gas with each step landing on the plurality of floor tiles.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

All illustrations of the drawings are for the purpose of describing selected embodiments of the present disclosure and are not intended to limit the scope of the present disclosure or accompanying claims.

The present disclosure describes using floor tiles to generate electricity. More specifically, a pressure applied on floor tiles is used to create motion in a fluid, and the fluid is used to operate a power system that generates electrical energy as an output.

Figure 1:
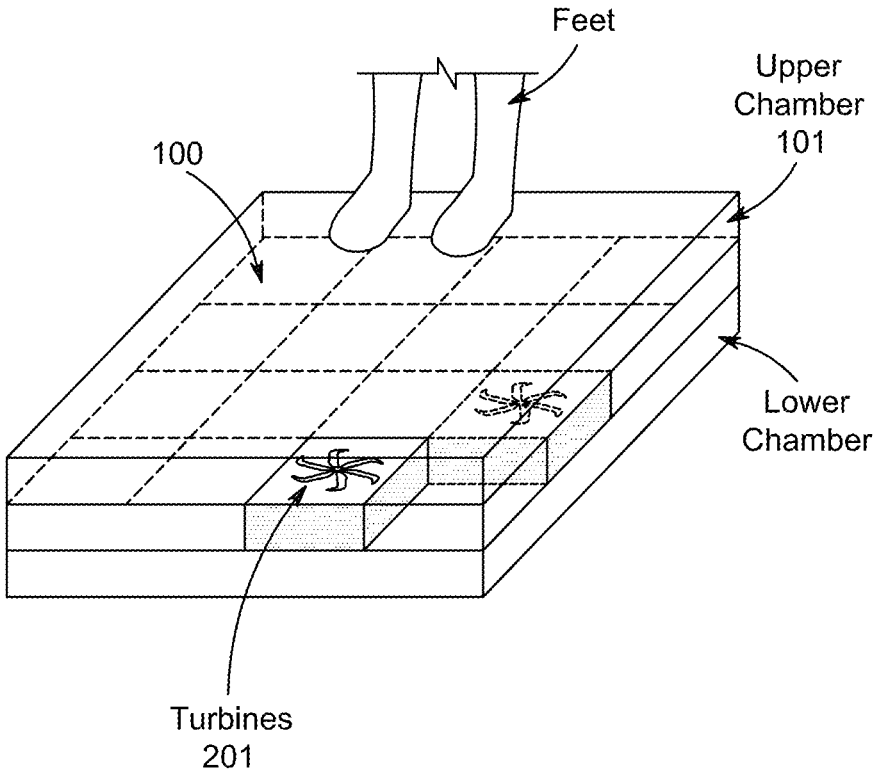
FIG. 1 is a first illustration of an embodiment of the system described in the present disclosure to generate electrical energy from pressure generated from pedestrians stepping on a plurality of floor tiles.
Figure 2:
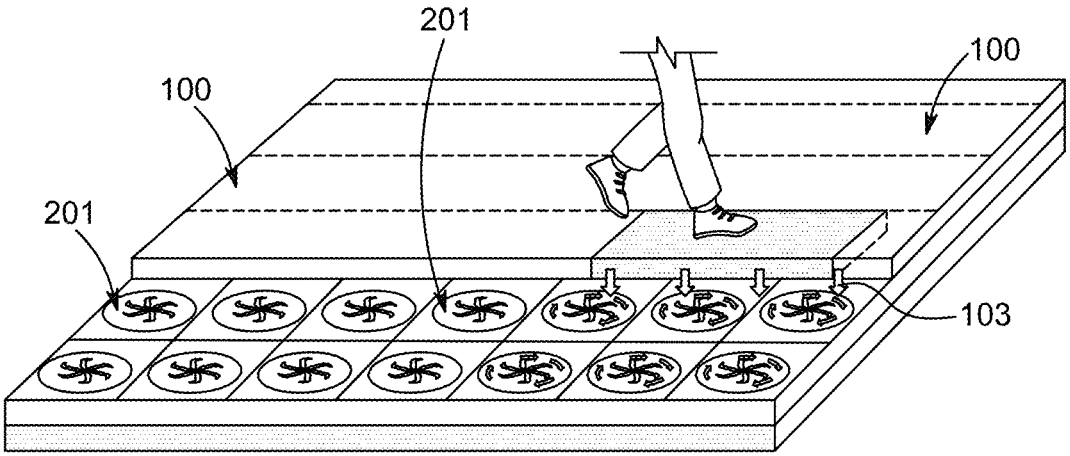
FIG. 2 is a second illustration of an embodiment of the system described in the present disclosure to generate electrical energy from pressure generated from pedestrians stepping on the plurality of floor tiles.
Figure 3:
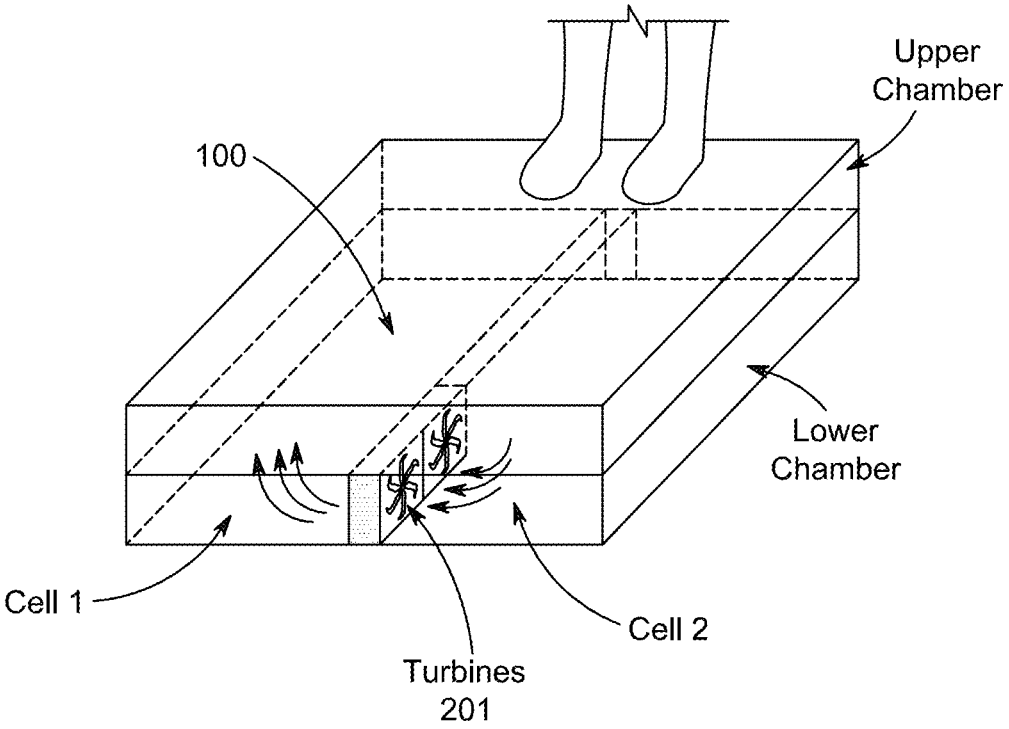
FIG. 3 is a third illustration of an embodiment of the system described in the present disclosure to generate electrical energy from pressure generated from pedestrians stepping on the plurality of floor tiles.

As illustrated in FIGS. 1-3, the energy generating system of the present disclosure comprises a plurality of floor tiles 100, a fluid 103, a power generating unit 200 comprising a plurality of turbines 201 and a generator 205, and a battery bank 300. When a pedestrian steps on the plurality of floor tiles 100, the pressure applied by the foot on the plurality of floor tiles 100 creates movement in the fluid 103. The movement of the fluid 103, which is confined in a fluid tank 107, is used to rotate the plurality of turbines 201. The rotational movement of the plurality of turbines 201 activates the generator 205 that produces electrical energy as an output. Electrical energy generated at the output of the power generating unit 200 is stored in the battery bank 300.

The system described in the present disclosure is activated when one or more pedestrians walk on the plurality of floor tiles 100. The plurality of floor tiles 100 can be installed in crowded areas that can be, but are not limited to, sidewalks, airports, train stations, and malls to ensure substantial pedestrian traffic on the floor tiles. The number of tiles used in the plurality of floor tiles 100 can vary according to the area in which the plurality of floor tiles 100 is installed. Preferably, the plurality of floor tiles 100 is modular in shape such that a smaller tile of the plurality of floor tiles 100 is an equal division of a larger tile selected from the plurality of floor tiles 100. Due to the modular shape, the plurality of floor tiles 100 will have no edges or walls, and thus movement will be generated in the fluid 103 regardless of the positioning of the foot on the plurality of floor tiles 100. The plurality of floor tiles 100 can be layered in different patterns that can be, but are not limited to, a soldier stacked pattern, a brick pattern, a stretcher bond pattern, a parquet pattern, and a herringbone pattern.

The plurality of floor tiles 100 preferably moves in a vertical direction such that movement in the fluid 103 is initiated by the pressure applied on the fluid 103 by the force of pedestrians or other activity on the plurality of floor tiles 100, wherein the fluid 103 is confined in the fluid tank 107 underneath the plurality of floor tiles 100. In a preferred embodiment, the plurality of floor tiles 100 is positioned atop an upper panel 101 that outlines the area in which the plurality of floor tiles 100 is installed. For example, if the plurality of floor tiles 100 is installed in a rectangular surface area, the upper panel 101 will also be rectangular in shape and the plurality of floor tiles 100 will be positioned on the upper panel 101 with the ability to move up and down with each step of a pedestrian. In particular, when the foot of the pedestrian lands on a selected tile of the plurality of floor tiles 100, the selected tile will move downwards. For the selected tile to move downwards, an internal pressure within the fluid tank 107 positioned underneath the plurality of floor tiles 100 is lesser than an ambient temperature. When the foot is released, the selected tile will return to an original position by moving upwards. For the selected tile to return to the original position, the internal pressure within the fluid tank 107 is preferably greater than the ambient pressure.

The plurality of floor tiles 100 used in the system of the present disclosure can vary in different embodiments. In a preferred embodiment, each of the plurality of floor tiles 100 is square in shape and has a length and width within a range of 25 centimeters (cm)-50 cm, 25 cm-40 cm, with a preferable length/width of 30 cm. A thickness of each of the plurality of floor tiles 100 is within a range of 3 cm-10 cm, 3 cm-8 cm, with a preferable thickness of 5 cm.

The type of the plurality of floor tiles 100 can be different in embodiments of the present disclosure. For example, the plurality of floor tiles 100 can be made of material that can be, but is not limited to, travertine, ceramic, marble, slate, faux wood, granite, and cement.

Travertine is a type of limestone that is a byproduct of natural artesian springs, hot springs, and caves from around the world. A natural, porous stone, the rough texture is caused by air bubbles and organic matter, and gives travertine tile properties such as varying colors.

Ceramic tiles are manufactured from clay materials that are quarried, prepared, and then formed into a mold. Ceramic tiles can be best characterized as either porcelain or non-porcelain. Porcelain tiles are often extruded and have fewer impurities than non-porcelain ceramic tiles. Porcelain clays are denser and less porous than ceramic clays, making porcelain tiles more rigid and more impervious to moisture than ceramic tile. Porcelain tiles are considered more durable and better suited for heavy usage. Non-porcelain ceramic tiles are one of the most economical ways to tile a house.

Faux wood is a type of tile that has an external appearance of wood. However, faux wood is a ceramic tile that has the benefits of being durable than hardwood, more water resistant, and free of termite-risk. Faux wood generally requires limited maintenance and offers a variety of design possibilities.

Marble is a highly durable stone that exists in a variety of colors due to the variability of component minerals. Marble tiles have multiple finishes from polished to honed and brushed to tumbled, making marble an ideal choice for any room in a house. As a natural stone, marble tiles offer high aesthetic value and add both elegance and value to a house. Marble tiles can be expensive and required extensive care. The absorbent nature makes marble tiles prone to stains, and is generally not acceptable for exteriors or in landscaping.

Slate is available in a range of colors, such as blue/grey, green, red, orange, or brown. Due to the veins of colors distributed throughout the, each slate tile is unique. Slate is naturally slip-resistant, even when wet or greasy, and may be ideal to be used in kitchens, bathrooms, or outdoor areas. Slate tiles are also durable and can be used to keep rooms cool or warm with circulating systems that run under the tile.

Granite is a type of igneous rock that is very dense and hard. The distinctive appearance is due to speckled minerals found within the rock, and its unique veining means no two granite floors are the same. Once polished, granite resists scratching, making granite an ideal choice for the kitchen and other high-traffic areas.

Cement tiles are mostly used in low-traffic areas in small quantities. Cement tiles are extremely versatile and can provide a variety of patterns and colors. Since cement tiles have a tendency to discolor over time, cement tiles may need to be sanded and resealed over time.

With each movement of the plurality of floor tiles 100 in the vertical direction, movement will occur in the fluid 103 that is positioned underneath the plurality of floor tiles 100. Preferably, the fluid tank 107 is used to confine the fluid 103 underneath and parallel to both the upper panel 101 and the plurality of floor tiles 100. The fluid 103, which is the working fluid for the plurality of turbines 201 is preferably water. The volume of the fluid tank 107 can vary in different embodiments of the present disclosure. In embodiments in which the pressure of the plurality of floor tiles 100 compresses a gas, air or other comparable gases may be used as the fluid 103.

Figure 6:
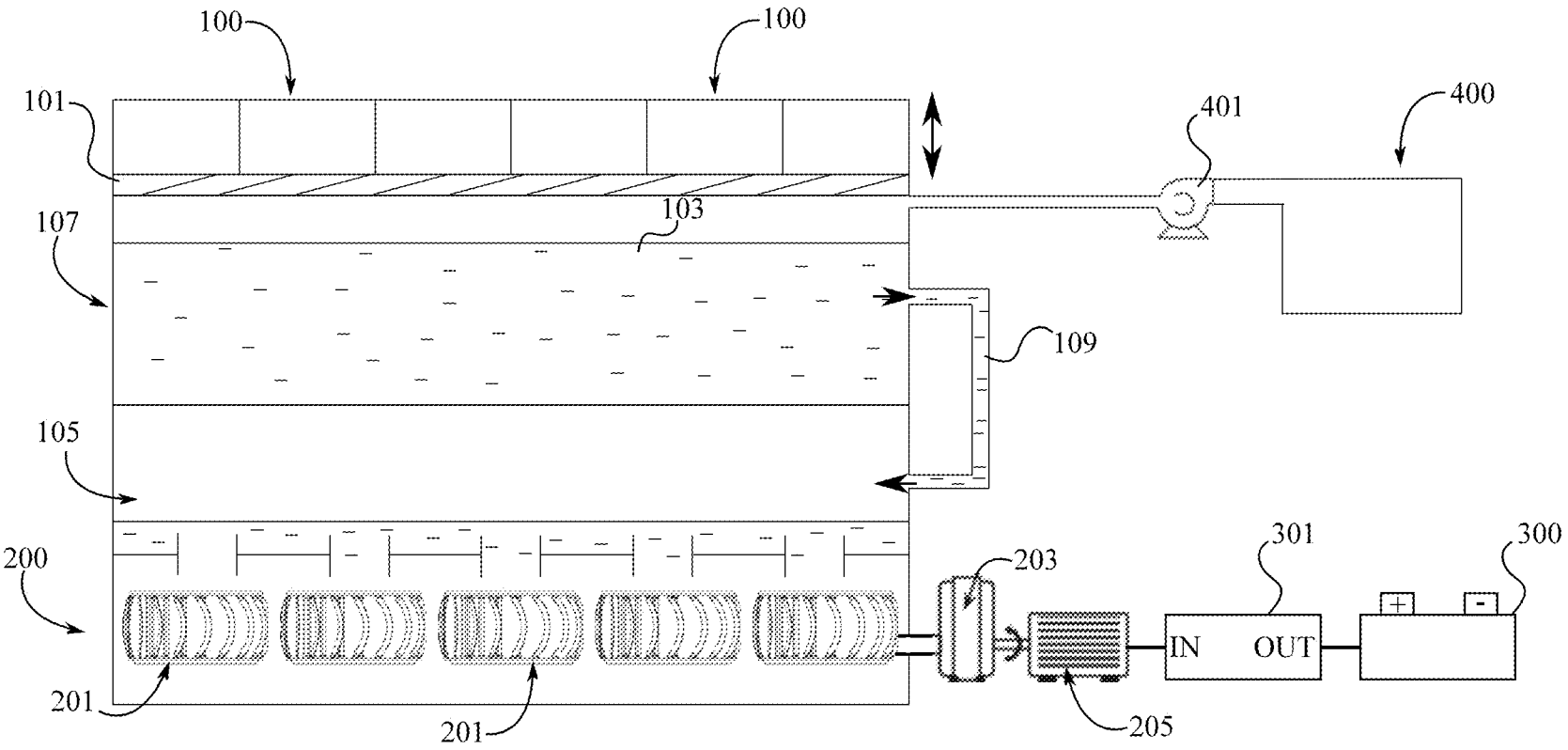
FIG. 6 is an illustration of a cross-sectional side view of the system described in the present disclosure.

The vertical movement of the plurality of floor tiles 100 and the upper panel 101 develops an internal pressure difference within the fluid tank 107 such that the fluid 103 confined within the fluid tank 107 moves into a plenum passage 105. To do so, as seen in FIG. 6, the fluid tank 107 is in fluid communication with the plenum passage 105 through a piping network 109.

The fluid 103 is operatively coupled with the plurality of turbines 201 through the plenum passage 105. Therefore, when the fluid 103 is moved by the internal pressure difference developed by the vertical movement of the plurality of floor tiles 100, the fluid 103 flows to the plurality of turbines 201 through the plenum passage 105.

Even though the plurality of turbines 201 is used to initiate a process of generating electrical energy from the movement of the fluid 103 in a preferred embodiment, in a different embodiment, a plurality of wave energy converters may be used, wherein a wave energy converter is a device that converts kinetic and potential energy associated with a moving wave into useful mechanical or electrical energy. Wave energy converters may be categorized as wave activated bodies (WABs), oscillating water columns (OWCs), and point absorbers/attenuators.

WABs are devices with moving elements that are directly activated by the cyclic oscillation of the waves generated in the fluid 103. Power is extracted by converting the kinetic energy of these displacing parts into electric current. One example of such a WAB, is made by a single floater connected to a linear magnetic generator which is fixed. In other cases, only parts of the body are fully immersed and dragged by the orbital movements of the fluid 103. In order to maximally exploit this resource, the moving compounds need to be small in comparison to the wavelength and preferably are placed half a wavelength apart. For these reasons, wave activated bodies are usually very compact and light.

The functioning of the OWCs is based on the principle of wave induced air pressurization. The device is set upon a closed air chamber which is placed above the fluid 103. The passage of waves changes the fluid level within the closed housing and the rising and falling fluid level increases and decreases the air pressure within the housing introducing a bidirectional air flow. By placing a turbine on top of this chamber air will pass in and out of it with the changing air pressure levels. A Wells turbine to create suction or pressure generating valves can be used to separate the bi-directional flow.

Point absorbers are buoy-type wave energy converters that harvest incoming wave-energy from all directions. A vertically submerged floater absorbs wave energy which is converted by a piston or linear generator into electricity.

The piping network 109 can be made of material that can be, but is not limited to, steel, ductile iron, concrete, or any material that can be mated with a material such as a metal, steel, plastic, copper, etc. The length of the piping network 109 and a diameter of a pipe within the piping network 109 may vary according to the fluid flow rate and the overall power output required from the power generating system. For example, if the rated power output is approximately 14 kilowatt (kW), wherein the rated power output is the maximum brake power output of a power generating unit 200, a pipeline diameter can be within a range of 550 millimeters (mm)-650 mm and 575 mm-625 mm, with a preferable diameter of 600 mm. In a different embodiment, if the rated power output is approximately 50 kW, the pipeline diameter can be within a range of 900 mm-1200 mm and 950 mm-1100 mm, with a preferable diameter of 1000 mm. In a different embodiment, if the rated power output is approximately 100 kW, the pipeline diameter can be within a range of 1200 mm-1600 mm and 1300 mm-1550 mm, with a preferable diameter of 1500 mm.

Figure 4:
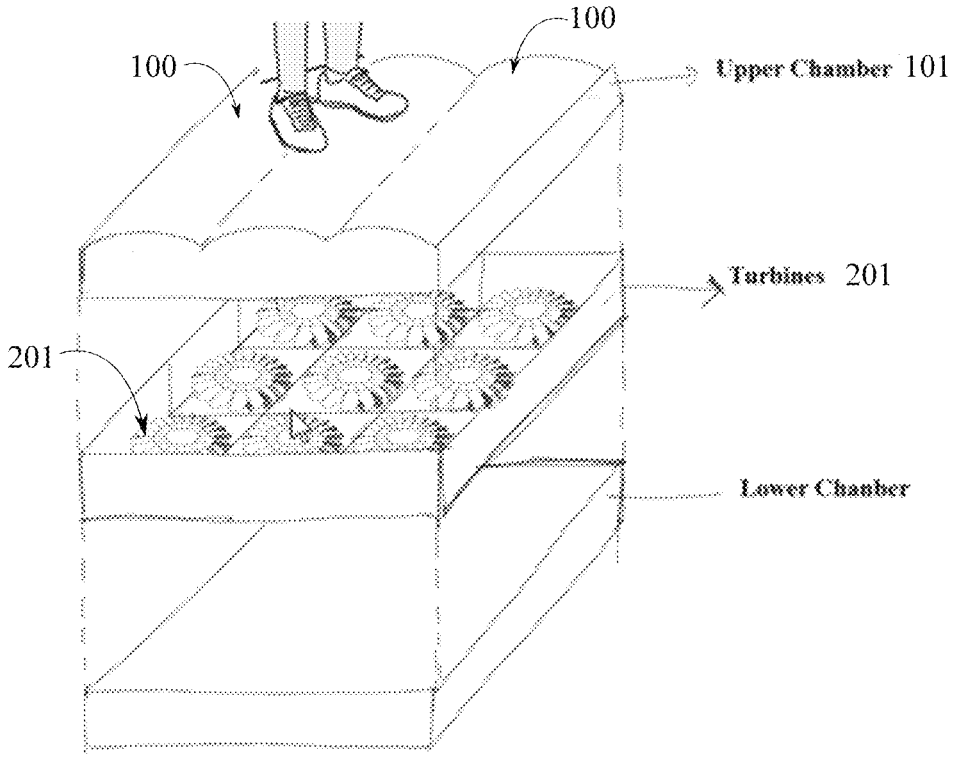
FIG. 4 is a first exploded view of an embodiment of the system described in the present disclosure to generate electrical energy from pressure generated from pedestrians stepping on the plurality of floor tiles.
Figure 4:
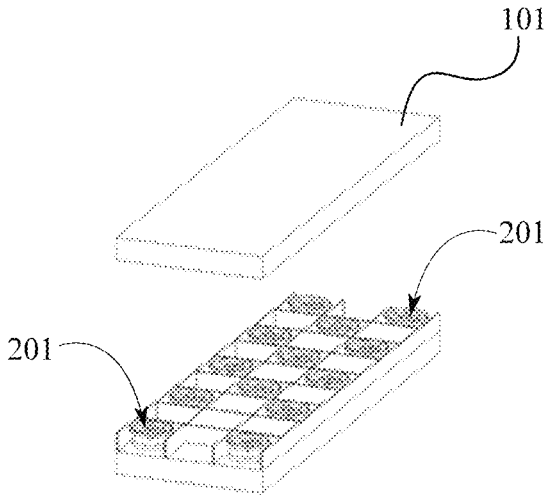
Figure 5:
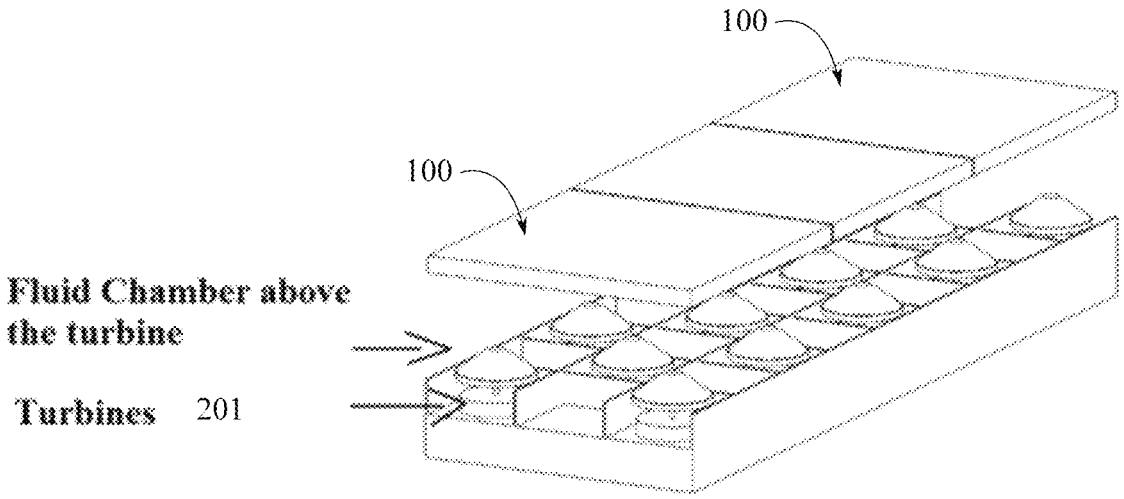
FIG. 5 is a second exploded view of an embodiment of the system described in the present disclosure to generate electrical energy from pressure generated from pedestrians stepping on the plurality of floor tiles.

The fluid 103, which moves due to the pressure applied by pedestrian traffic on the plurality of floor tiles 100, is transferred along the piping network 109 and the plenum passage 105 to be delivered to the plurality of turbines 201 of the power generating unit 200. As illustrated in FIG. 4 and FIG. 5, in a preferred embodiment, the plurality of turbines 201 is preferably positioned underneath the fluid tank 107. As described earlier, when a foot lands on a selected tile from the plurality of floor tiles 100, a pressure is applied on the fluid 103 and flow is initiated in the fluid 103 by the selected tile pressing downwards. The flow initiated by the selected tile pressing downwards results in the fluid 103 flowing to the plurality of turbines 201 via the plenum passage 105. When the foot is released from the selected tile, the pressure previously applied on the fluid 103 is released, and movement is generated in the fluid 103 with the release of pressure. The movement generated in the fluid 103 results in the fluid 103 flowing to the plurality of turbines 201 through the piping network 109 to rotate the plurality of turbines 201. Since movement is generated in the fluid 103 from the selected tile moving in opposite directions, the flow to the plurality of turbines 201 is bidirectional. To utilize the bidirectional flow of the fluid 103, each of the plurality of turbines 201 is preferably a bidirectional flow turbine.

In general, a bidirectional turbine includes one or more guide-vane (GV) rows and a rotating blade row. One GV row deflects the flow of fluid 103 toward the rotor blade (RB) inlet while the other GV row directs the RB exit flow. The type of turbines used as the plurality of turbines 201 in the system of the present disclosure can be, but is not limited to, impulse turbines and reaction turbines.

Impulse turbines can be categorized as pelton turbines, turgo turbines, and crossflow turbines. The pelton turbine includes a wheel with a series of split buckets set around a rim and a high velocity jet of water is directed tangentially at the wheel. The jet hits each bucket and is split in half, so that each half is turned and deflected back almost through 180—degrees. Nearly all the energy of the water goes into propelling the bucket and the deflected water falls into a discharge channel below.

The turgo turbine is similar to the pelton but the jet strikes the plane of the runner at an angle (typically 20 degrees –25 degrees) so that the water enters the runner on one side and exits on the other. Therefore, the flow rate is not limited by the discharged fluid interfering with the incoming jet (as is the case with pelton turbines). As a consequence, a turgo turbine can have a smaller diameter runner and rotate faster than a pelton for an equivalent flow rate.

The crossflow turbine has a drum-like rotor with a solid disk at each end and gutter-shaped "slats" joining the two disks. A jet of water enters the top of the rotor through the curved blades, emerging on the far side of the rotor by passing through the blades a second time. The shape of the blades is such that on each passage through the periphery of the rotor the water transfers some of its momentum, before falling away with little residual energy.

Reaction turbines exploit the oncoming flow of a fluid such as water to generate hydrodynamic lift forces to propel the runner blades. Reaction turbines are distinguished from the impulse type by having a runner that always functions within a completely liquid-filled casing. Reaction turbines have a diffuser known as a 'draft tube' below the runner through which the water discharges. The draft tube slows the discharged water and so creates suction below the runner which increases the effective head. Reaction turbines can be seen as propeller type, Francis type, and Pit-Francis type.

Propeller-type turbines are similar in principle to the propeller of a ship, but operating in reversed mode. A set of inlet guide vanes admits the flow to the propeller and these are often adjustable so as to allow the flow passing through the machine to be varied. In some cases the blades of the runner can also be adjusted, in which case the turbine is called a Kaplan. The mechanics for adjusting turbine blades and guide vanes can be costly and tend to be more affordable for large systems, but can greatly improve efficiency over a wide range of flows.

The Francis turbine type is essentially a modified form of propeller turbine in which water flows radially inwards into the runner and is turned to emerge axially. For medium-head schemes, the runner is most commonly mounted in a spiral casing with internal adjustable guide vanes.

Pit-Francis turbine type was originally designed as a low-head machine, installed in an open chamber (or 'pit') without a spiral casing. Although an efficient turbine, it was eventually superseded by the propeller turbine which is more compact and faster-running for the same head and flow conditions. However, many of these 'open-flume' or 'wall plate' Francis turbines are still in place, hence this technology is still relevant for refurbishment schemes.

In addition to the plurality of turbines 201, the power generating unit 200, which utilizes the flow of the fluid 103 to generate electrical energy, comprises a drive system 203 and a generator 205. Preferably, the power generating unit 200 satisfies the Institute of Electrical and Electronics Engineers (IEEE) standards that can be, but is not limited to, IEEE 1207-2004—IEEE Guide for the Application of Turbine Governing Systems for Hydroelectric Generating Units, IEEE 810-2015—IEEE Standard for Hydraulic Turbine and Generator Shaft Couplings and Shaft Runout Tolerances, IEEE 810-1987—IEEE Standard for Hydraulic Turbine and Generator Integrally Forged Shaft Couplings and Shaft Runout Tolerances, IEEE 67-1990—IEEE Guide for Operation and Maintenance of Turbine Generators, and IEEE 125-2007—IEEE Recommended Practice for Preparation of Equipment Specifications for Speed-Governing of Hydraulic Turbines Intended to Drive Electric Generators.

Figure 7:
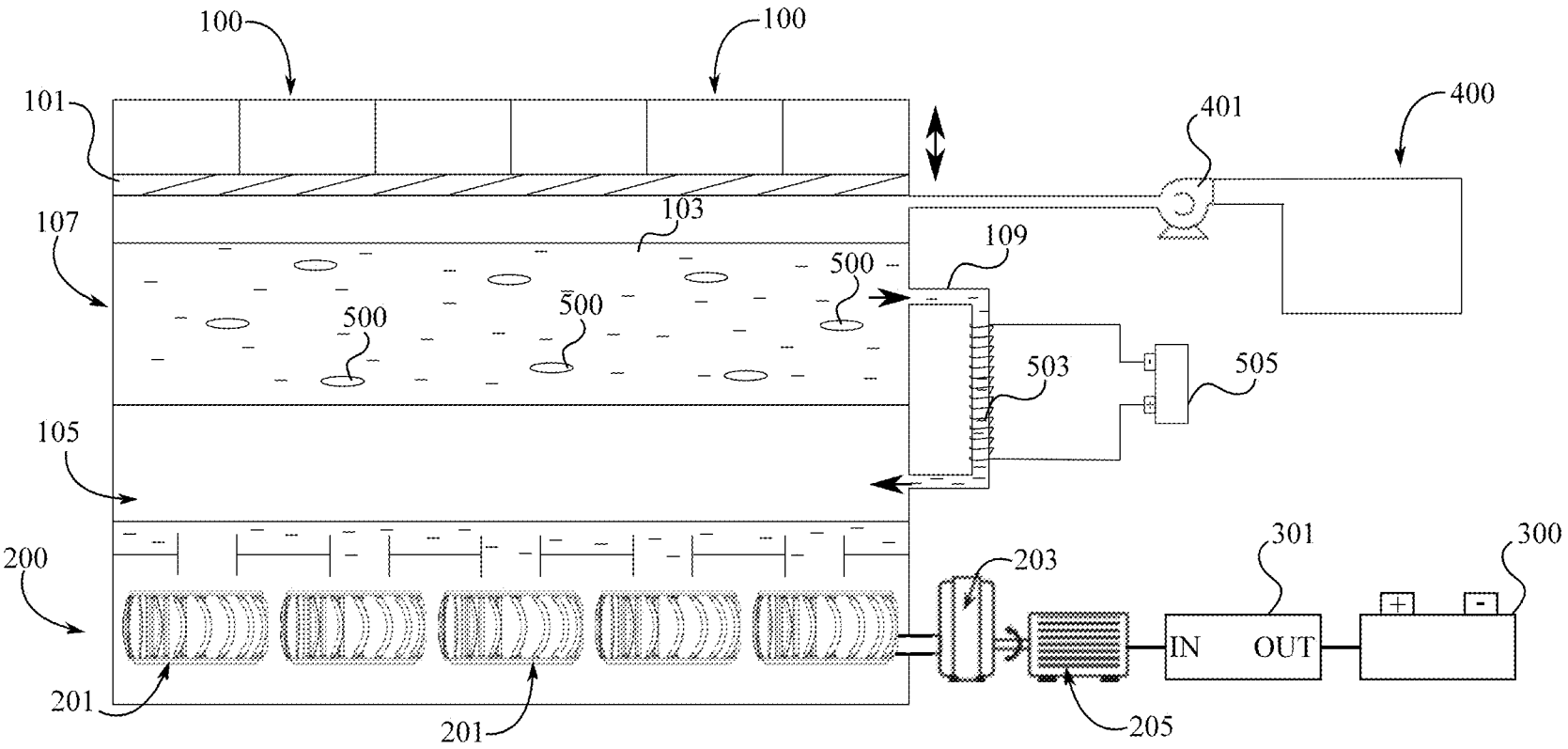
FIG. 7 is an illustration of a cross-sectional side view of the system described in the present disclosure, wherein a fluid used with the system of the present disclosure contains metal particles.
Figure 8:
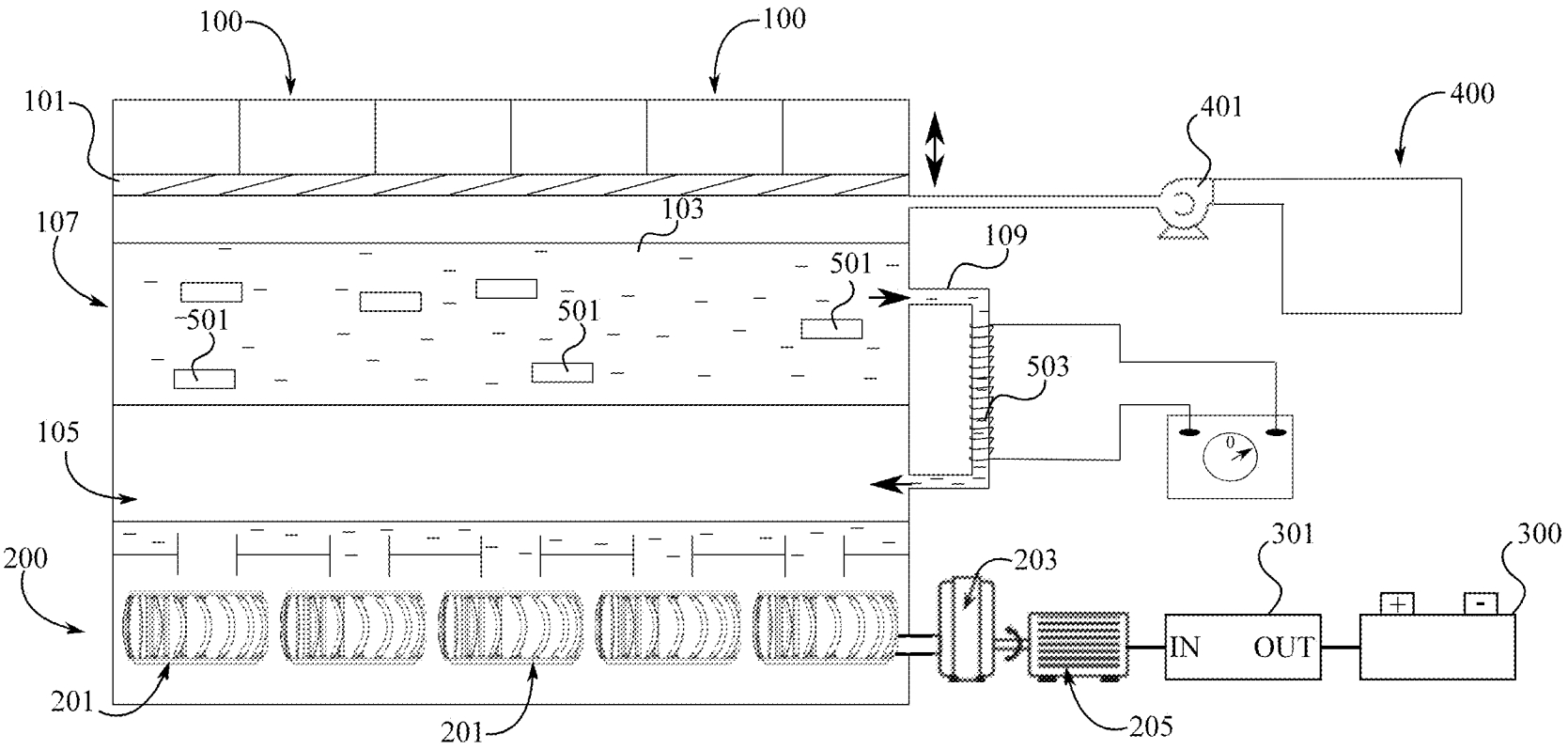
FIG. 8 is an illustration of a cross-sectional side view of the system described in the present disclosure, wherein a fluid used with the system of the present disclosure contains magnetic particles.

As seen in FIGS. 6-8, the plurality of turbines 201 is rotatably engaged to the generator 205 through the drive system 203. In particular, a first end of the drive system 203 is allowed to spin according to the plurality of turbines 201 that is spun by the fluid 103. At a second end, which is opposite to the first end, the generator 205 is driven at a frequency sufficient to generate a required voltage. The drive system 203 transmits power from a turbine shaft extending from the plurality of turbines 201 to a generator shaft of the generator 205. The drive system 203 also has the function of changing the rotational speed from one shaft to the other when the turbine speed is different to the required speed at the generator 205. The drive system 203 can be, but is not limited to, a direct drive system, a flat belt and pulleys, a wedge belt and pulleys, a chain and sprocket system, or a gearbox.

In an embodiment of the present disclosure, a direct drive system may be used as the drive system 203 of the power generating unit 200. In a direct drive system, the plurality of turbines 201 and the generator 205 have a 1:1 coupling, wherein both the plurality of turbines 201 and the generator 205 spin at the same speeds. The alignment between a turbine shaft and a generator shaft is critical with a direct drive system. Low maintenance, high efficiency, and low cost are some of the advantages of a direct drive system.

In an embodiment of the present disclosure, flat belts and pulleys may be used as the drive system 203 of the power generating unit 200. Flat belts operate at high tension and are made of a strong inner band coated with a high friction material such as rubber. Flat belts generally have higher efficiencies than V-belts drives and operate with less rubber dust. When in use, one pulley must have a slightly convex profile (crowned) which together with good alignment, keeps the belt in position in either vertical or horizontal use. The main disadvantage is that a higher tension is needed than with other drive systems. As a result, the bearings suffer high loads, sometimes requiring additional layshafts to be used or standard alternators to be fitted with heavier duty bearings. Flat belts generally require narrower pulleys than the equivalent multi V-belt with advantages in cost and reduced overhang.

In an embodiment of the present disclosure, wedge belts and pulleys may be used as the drive system 203 of the power generating unit 200. Generally, a wedge belt and pulley drive system is the most common choice for micro hydropower schemes, wherein micro hydropower systems are generally classified as having a generating capacity of less than 100 kW. Being widely available is an advantage associated with wedge belts. Also known as V-belts, wedge belts differ from flat belts in that the frictional grip on the pulley is caused by wedging action of the side walls of the belt within the pulley grooves. Therefore, less longitudinal tension is required to maintain the grip and less radial load is imposed on the shaft and bearings. Usually a number of V-belts are run side by side in multiple-governed pulleys. Matched sets of belts are required to ensure even tension.

In an embodiment of the present disclosure, a chain and sprocket system may be used as the drive system 203 of the power generating unit 200. Chain drives tend to be similar in efficiency to belt drives.

In an embodiment of the present disclosure, a gearbox may be used as the drive system 203 of the power generating unit 200. In general, a gearbox converts a low turbine speed into a very high generator speed. High operational reliability, oil-free shaft ends for the turbines and the generator 205, and having strong input shafts and bearings for absorbing high, external axial loads are some of the advantages associated with using a gearbox as the drive system 203. If a constant generator speed needs to be maintained, the gearbox may be designed to include a planetary gearbox in which a ring gear is fixed. An input is received from a turbine and an output is extracted from the sun gear coupled to the generator 205 such that the input speed amplifies depending on a transmission ratio. On the other hand, if the ring gear is allowed to rotate in the direction of the planet gear, the output speed equals the sum of amplified speed due to carrier and amplified speed due to ring gear. When the ring gear rotates in the direction opposite to the planet gear, the ring gear motion opposes the planet gear motion resulting in a reduced output such that the output speed equals difference in speed due to carrier and speed due to ring gear. Accordingly, a gearbox may be designed for maintaining constant generator speed, wherein the planetary gearbox includes a sun gear, a planet carrier, and a ring gear.

As described, the plurality of turbines 201 is rotatably engaged to the generator 205 through the drive system 203. The generator 205 transforms the rotational energy received from the plurality of turbines 201 into electrical energy. In one embodiment of the present disclosure, the generator 205 can be an alternating current (AC) generator, and in another embodiment of the present disclosure the generator can be a direct current (DC) generator.

If the generator 205 used with the system of the present disclosure is an AC generator, the generator 205 can be either an induction generator or a synchronous generator. Induction generators operate by mechanically turning their rotors faster than synchronous speed. When the generator 205 is an induction generator, a regular AC induction motor usually can be used as a generator, without any internal modifications. Induction generators are useful in applications such as mini hydro power plants, wind turbines, or in reducing high-pressure gas streams to lower pressure, because they can recover energy with relatively simple controls. When the generator 205 is a synchronous generator, mechanical power transferred from the plurality of turbines 201 and through the drive system 203 is converted into an AC electrical power at a particular voltage and frequency. The synchronous generator works on the principle of Faraday laws of electromagnetic induction. The rotating and stationary parts of an electrical machine are called a rotor and a stator respectively. The rotor or stator of the synchronous generator acts as a power-producing component and is called as an armature. The electromagnets or permanent magnets mounted on the stator or rotor are used to provide a magnetic field. Relative motion between a conductor and the magnetic field induces an electromagnetic force (EMF) on the conductor.

If the generator 205 used with the system of the present disclosure is a DC generator, the DC generator can be used to convert mechanical energy transferred to the DC generator into direct current electricity. The energy conversion is based on the principle of production of dynamically induced EMF. DC generator can be classified as permanent magnet DC generators, separately excited DC generators, and self-excited generators. In permanent magnet DC generators, the flux in the magnetic circuit is created through the use of permanent magnets. In separately excited DC generators, the filed magnets used to create a magnetic field are energized through an external DC source such as a battery. In self-excited DC generators, the current to the field winding is supplied by the generator 205 itself.

If a DC generator is used with the system of the present disclosure, in one embodiment, the generator 205 used with the system can be a permanent magnet DC generator. In another embodiment, the generator 205 of the system of the present disclosure can be a separately excited DC generator. In another embodiment, the generator 205 of the system of the present disclosure can be a self-excited DC generator.

As described earlier, the electrical energy generated by the power generating unit 200 of the present disclosure is stored in the battery bank 300, wherein the battery bank 300 comprises a set of batteries. Each of the set of batteries can be connected to each other in series or in parallel. To store electrical energy in the battery bank 300, the generator 205 is electrically connected to the battery bank 300 through a power control system 301 that regulates the output of the generator 205. The power control system 301 is used to regulate the electrical energy generated from the bidirectional flow the plurality of turbines 201. Each of the batteries of the battery bank 300 can be, but is not limited to, a lithium ion battery, a lead acid battery, or a nickel-cadmium battery. The voltage of the battery bank 300 can be, but is not limited to, 12 Volts (V), 24 V, and 48 V. The battery bank 300 can be used to provide continuous power even when electrical energy is not generated from the system of the present disclosure.

When sizing a battery bank for a stand-alone system, the number of kilowatt hours of electricity that will be consumed each day needs to be calculated. Next, the number of days that requires energy storage is determined. The resulting figure will vary depending on the average daily electrical consumption. For example, if only one electronic device is powered by the battery bank 300, the amount of energy stored will be dependent on factors that can be, but are not limited to, the electronic device that is being used and the energy generated by the micro-hydro system connected to the battery bank.

If the battery bank 300 is a lead-acid type battery bank, the temperature of a storage area used to store the battery bank has a strong effect on the amount of electricity the lead acid battery can hold. In general, the capacity of lead acid batteries temporarily diminishes to about 20% of the effective capacity when the temperature falls below 30° F., compared to their rated capacity at 77° F., the standard for battery ratings. Therefore, the storage area for the battery bank 300 needs to preferably be within a range of 50° F.-80° F. if a lead acid battery type battery bank is used with the system of the present disclosure.

When the system described in the present disclosure is used outdoors, the system is exposed to varying environmental conditions. As a result of being in high temperature conditions, the fluid 103 may expand over time. To maintain the levels of the fluid 103 within the fluid tank 107 the system of the present disclosure further comprises at least one overflow tank, wherein the at least one overflow tank is in fluid communication with the fluid tank 107. Thus, any overflow within the fluid tank 107 can be transferred to the at least one overflow tank. To manage the excess of fluid between the fluid tank 107 and the at least one external overflow tank 400, at least one pump 401 can be integrated into the piping network 109 carrying the fluid 103. In contrast to transferring the fluid 103 to the at least one external overflow tank 400, if required, the fluid 103 can also be transferred to the fluid tank 107 from the at least one external overflow tank 400 during cold weather conditions. In order to maintain a preferred volume of the fluid 103 in the fluid tank 107, a fluid level sensor can be integrated into the fluid tank 107. The fluid level sensor can be, but is not limited to, a float, a displacer, a bubbler, a differential pressure transmitter, a load cell, a magnetic level gauge, and a capacitance transmitter.

The principle behind magnetic, mechanical, cable, and other float level sensors often involves the opening or closing of a mechanical switch, either through direct contact with the switch, or magnetic operation of a reed. In other instances, such as magnetostrictive sensors, continuous monitoring is possible using a float principle.

Displacers, bubblers, and differential pressure transmitters are hydrostatic measurement devices. Any change in temperature will therefore cause a shift in the specific gravity of the liquid, as will changes in pressure that affect the specific gravity of the vapor over the liquid. Both result in reduced measurement accuracy. Displacers work on the Archmedes' principle. When in use, a column of solid material, which functions as the displacer, is suspended within a fluid containing tank. The density of the displacer is selected to be greater than the fluid within the tank, and the displacer must extend from the lowest level required to at least the highest level to be measured. As the fluid level rises, the column displaces a volume of fluid equal to the cross-sectional area of the column multiplied by the fluid level in the displacer. A buoyant force equal to the displaced volume multiplied by the fluid density pushes upward on the displacer, reducing the force needed to support the displacer against the pull of gravity. The transducer, which is linked to a transmitter, monitors and relates the change in force to level.

A bubbler level sensor is generally used in tanks that operate under atmospheric pressure. A dip tube having an open end near the tank opening carries a purge gas, which is typically air, into the tank. As gas flows down to the outlet of the dip tube, the pressure in the tube rises until the pressure overcomes the hydrostatic pressure produced by the liquid level at the outlet. The pressure equals the density of the fluid multiplied by a depth from the end of the dip tube to the surface, and is monitored by a pressure transducer connected to the tube.

A differential pressure (DP) level sensor measures the difference between total pressure at the bottom of the tank (hydrostatic head pressure of the fluid plus static pressure in the tank) and the static or head pressure in the tank. In contrast to bubblers, DP sensors can be used in unvented (pressurized) tanks.

A load cell or strain gauge device is essentially a mechanical support member or bracket equipped with one or more sensors that detect small distortions in the support member. As the force on the load cell changes, the bracket flexes slightly, causing output signal changes. Calibrated load cells have been made with force capacities ranging from fractional ounces to tons. When used for measuring levels, the load cell is incorporated into the support structure of the tank.

Magnetic level gauges are similar to float devices, but communicate liquid surface location magnetically. The float, carrying a set of strong permanent magnets, rides in an auxiliary column (float chamber) attached to the tank by means of two process connections. The column confines the float laterally so that the float is always close to a side wall of the tank. As the float rides up and down the fluid level is indicated by a magnetized shuttle or bar graph indication moving with the float, showing the position of the float and thereby providing the level indication. The system can work only if the auxiliary column and chamber walls are made of non-magnetic material.

Capacitance transmitters operate on the fact that fluids generally have dielectric constants significantly different from air. The technology of capacitance transmitters requires a change in capacitance that varies with the liquid level, created by either an insulated rod attached to the transmitter and the fluid, or an un-insulated rod attached to the transmitter and either the tank wall or a reference probe. As the fluid level rises and fills more of the space between the plates, the overall capacitance rises proportionately. An electronic circuit called a capacitance bridge measures the overall capacitance and provides a continuous level measurement.

According to Faraday's law, any change in the magnetic environment of a coil of wire will cause a voltage (EMF) to be induced in the coil. No matter how the change is produced, the voltage will be generated. The change could be produced by changing the magnetic field strength, moving a magnet toward or away from the coil, moving the coil into or out of the magnetic field, rotating the coil relative to the magnet, etc. As seen in FIG. 7, utilizing the concept outlined by Faraday's law, in one embodiment of the present disclosure, a plurality of metal particles 500 may be present in the fluid 103 and the piping network 109 may be wrapped by a plurality of coils 503 that is electrically connected to an external power source 505. The external power source 505 can be a battery or other comparable voltage source. In one embodiment, the plurality of coils 503 may be connected to the battery bank 300 of the system described in the present disclosure. By connecting the plurality of coils 503 to the external power source 505, the plurality of coils 503 is converted to a current carrying conductor with a magnetic field developed through the center of each of the plurality of coils 503. When the fluid 103 with the plurality of metal particles 500 flows through the piping network 109 the magnetic field developed by the plurality of coils 503 changes, and thus, a current is induced in the plurality of coils 503. The induced current may be used to power an external load.

As shown in FIG. 8, in a different embodiment, a plurality of magnetic particles 501 may be present in the fluid 103. Therefore, when the fluid 103 flows through the piping network 109, which is wrapped by a plurality of coils 503, a magnetic field of each of the plurality of magnetic particles 501 changes and thus, a current is induced in the plurality of coils 503. The induced current may be used to power an external load.

Even though a fluid is used to operate the power generating unit 200 in a preferred embodiment, in another embodiment of the present disclosure a gas may be used to operate the power generating unit 200.

The power generated from the system of the present disclosure can be calculated as:

$$P=m\times g\times H_{net}\times\eta$$

Where:

P—Power measured in Watts (W);

m—Mass flow rate (kilogram/second (kg/s));

g—Gravitational constant—9.81 meters/second (m/s);

$H_{net}$—Net head;

η—Product of component efficiencies;

In fluid dynamics, head is a concept that relates the energy in an incompressible fluid to the height of an equivalent static column of that fluid. The net head is generally defined as the gross head minus all hydraulic losses except those chargeable to the plurality of turbines 201. When net losses are assumed to be 10%, the net head can be defined as:

$$H_{net}=H_{gross}\times 0.9$$

In accordance with the efficiencies of a small hydro system, the efficiency of the plurality of turbines 201 is preferably within a range of 40%-90%, with a preferable efficiency of 85%. The drive system 203 efficiency is within a range of 92%-97%, with a preferable efficiency of 95%. The generator 205 efficiency is within a range of 90%-95%, with a preferable efficiency of 93%. Therefore, the overall efficiency of the power generating unit 200 is calculated as: Power generating unit efficiency=η=0.85×0.95×0.93=0.751 i.e. 75.1%

If the gross head is relatively low, approximately 5 cm (0.05 m), and a maximum flow rate of the plurality of turbines 201 is 0.0045 cubic meters/second ($m^3/s$), then the maximum power output of the system can be calculated as follows.

Net Head:

$$H_{net}=H_{gross}\times 0.9=0.05\times 0.9=0.045\text{ m}$$

Flow rate: 4.5 kg/s;

1 kg/s=1 liter/second (Us);

Therefore, flow rate=4.5 l/s

Therefore, the power generated from the system of the present disclosure can be calculated as:

$$P=m\times g\times H_{net}\times\eta$$

$$P=4.5\times 9.81\times 0.045\times 0.751=1.49\text{ W per step.}$$

Assuming the gait rate in a preferred embodiment is three steps every two seconds (1.5 steps per second), the number of steps an average person would walk in an hour is calculated as:

$$60\times 60\times 1.5=5400\text{ steps.}$$

The overall power generated within an hour from one pedestrian can be calculated as:

$$5400\times 1.49=8046\text{ Watts.}$$

If the plurality of floor tiles 100 is distributed over an area with a length of 1 kilometer and a width of 1 meter, with the dimensions for a tile as in the preferred embodiment, 11,111 tiles will be used as the plurality of floor tiles 100.

Assuming that the pedestrians stepping on the plurality of floor tiles 100 are walking side by side, and that each of the pedestrians occupies an area of 1 $m^2$, 1000 pedestrians can be accommodated on the plurality of floor tiles 100. From the 1000 pedestrians, if 750 pedestrians are moving at the same time, an overall power of 6034.5 kW (8046 W×750) may be generated. The power output calculations for a preferred embodiment of the present disclosure is listed in the following table.

Tile Reservoir Size

| Item | Value | Units |
|---|---|---|
| Width | 0.3 | meter |
| Depth | 0.3 | meter |
| Height | 0.05 | meter |
| Volume | 0.0045 | m^3 |

Power from water flow

| Item | Value | Units |
|---|---|---|
| m = Flow Rate | 4.5 | Liter/sec |
| g | 9.81 | (m/s^2) |
| Hnet (head) | 0.045 | meter |
| Head Efficiency | 75% | |
| Power: Watt/step | 1.49183 | Watt/step |
| No of steps/hour | 5,400 | steps |
| Total Power per hour per tile | 8046 | watt/hr/tile |

Sidewalk Calculations

| | | |
|---|---|---|
| Width | 1 | meter |
| Length | 1,000 | meter |
| Area | 1,000 | m^2 |
| Number of tiles needed | 11,111.11 | tiles |
| Occupancy (average) | 75% | |
| Number of people walking at the same time = # of tiles actually being pressed on | 750 | tiles |
| Total power generated per hour for 1 km length and 1 m width pedestrian sidewalk | 6,034.5 | Kilo Watt/hr |

Terminology used herein is for the purpose of describing particular embodiments only and is not intended to be limiting of the invention.

As used herein, the singular forms "a", "an" and "the" are intended to include the plural forms as well, unless the context clearly indicates otherwise.

As used herein, the term "and/or" includes any and all combinations of one or more of the associated listed items and may be abbreviated as "/".

As used herein in the specification and claims, including as used in the examples and unless otherwise expressly specified, all numbers may be read as if prefaced by the word "substantially", "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), +/−20% of the stated value (or range of values), etc. Any numerical range recited herein is intended to include all sub-ranges subsumed therein.

Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10 it also describes subranges for Parameter X including 1-9, 1-8, 1-7, 2-9, 2-8, 2-7, 3-9, 3-8, 3-7, 2-8, 3-7, 4-6, or 7-10, 8-10 or 9-10 as mere examples. A range encompasses its endpoints as well as values inside of an endpoint, for example, the range 0-5 includes 0, >0, 1, 2, 3, 4, <5 and 5.

Spatially relative terms, such as "under", "below", "lower", "over", "upper", "in front of" or "behind" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

Obviously, numerous modifications and variations of the present invention are possible in light of the above teachings. It is therefore to be understood that within the scope of the appended claims, the invention may be practiced otherwise than as specifically described herein.

The invention claimed is:

1. An energy generating system using floor tiles and fluid movement, comprising:

a plurality of floor tiles, wherein the plurality of floor tiles is positioned atop an upper panel, wherein the plurality of floor tiles and the upper panel are configured to permit all or a portion of the plurality of floor tiles to move in a vertical direction, and wherein the vertical movement of the plurality of floor tiles moves a fluid confined in a fluid tank, wherein the fluid contains a plurality of metal particles;

wherein the fluid tank is positioned underneath and parallel to the upper panel and the plurality of floor tiles, wherein an internal pressure difference developed within the fluid tank by the vertical movement of the plurality of floor tiles moves the fluid into a plenum passage, wherein the fluid tank is in fluid communication with the plenum passage through a piping network, wherein the piping network is wrapped by a plurality of coils electrically connected to an external power source, wherein a flow of the metal particles through the piping network inducts a current in the plurality of coils;

the fluid being operatively coupled with a plurality of turbines of a power generating unit through the plenum passage, wherein the fluid moved by the plurality of floor tiles flows to the plurality of turbines via the plenum passage to rotate the plurality of turbines;

the plurality of turbines being rotatably engaged with a generator through a drive system, wherein the power generating unit comprises the drive system and the generator; and the generator being electrically connected to a battery bank through a power control system, wherein an electric output of the generator is regulated by the power control system and is stored in the battery bank.

2. The energy generating system of claim 1, wherein each of the plurality of turbines is a bidirectional flow turbine.

3. The energy generating system of claim 1, further comprising:

at least one external overflow tank; and wherein the fluid tank is in fluid communication with the at least one external overflow tank through the piping network, wherein at least one pump is integrated into the piping network to transfer the fluid from the fluid tank to the at least one external overflow tank.

4. The energy generating system of claim 1, wherein a length of each of the plurality of floor tiles is within a range of 25 centimeters (cm)-50 cm, wherein a width of each of the plurality of floor tiles is within a range of 25 cm-50 cm, wherein a height of each of the plurality of floor tiles is within a range of 3 cm-10 cm.

5. The energy generating system of claim 1, wherein each of the plurality of floor tiles is modular in shape such that a smaller tile selected from the plurality of floor tiles is an equal division of a larger tile selected from the plurality of floor tiles.

6. The energy generating system of claim 1, wherein the plurality of floor tiles is layered in a soldier stacked pattern.

7. The energy generating system of claim 1, wherein the plurality of floor tiles is layered in a brick pattern.

8. The energy generating system of claim 1, wherein the plurality of floor tiles is layer in a stretcher bond pattern.

9. The energy generating system of claim 1, wherein the plurality of floor tiles is layered in a parquet pattern.

10. The energy generating system of claim 1, wherein the plurality of floor tiles is layered in a herringbone pattern.

11. The energy generating system of claim 1, wherein an efficiency of the plurality of turbines is within a range of 80%-90%.

12. The energy generating system of claim 1, wherein an efficiency of the drive system is within a range of 92%-97%.

13. The energy generating system of claim 1, wherein the efficiency of the generator is within a range of 90%-95%.

14. An energy generating system using floor tiles and fluid movement, comprising:

a plurality of floor tiles, wherein the plurality of floor tiles is positioned atop an upper panel, wherein the plurality of floor tiles and the upper panel are configured to permit all or a portion of the plurality of floor tiles to move in a vertical direction, and wherein the vertical movement of the plurality of floor tiles moves a fluid confined in a fluid tank, wherein the fluid contains a plurality of magnetic particles;

wherein the fluid tank is positioned underneath and parallel to the upper panel and the plurality of floor tiles, wherein an internal pressure difference developed within the fluid tank by the vertical movement of the plurality of floor tiles moves the fluid into a plenum passage, wherein the fluid tank is in fluid communication with the plenum passage through a piping network, the piping network is wrapped by a plurality of coils, wherein a flow of the magnetic particles through the piping network inducts a current in the plurality of coils;

the fluid being operatively coupled with a plurality of turbines of a power generating unit through the plenum passage, wherein the fluid moved by the plurality of floor tiles flows to the plurality of turbines via the plenum passage to rotate the plurality of turbines;

the plurality of turbines being rotatably engaged with a generator through a drive system, wherein the power generating unit comprises the drive system and the generator; and the generator being electrically connected to a battery bank through a power control system, wherein an electric output of the generator is regulated by the power control system and is stored in the battery bank.

15. The energy generating system of claim 14, wherein each of the plurality of turbines is a bidirectional flow turbine.

16. The energy generating system of claim 14, further comprising:

at least one external overflow tank; and wherein the fluid tank is in fluid communication with the at least one external overflow tank through the piping network, wherein at least one pump is integrated into the piping network to transfer the fluid from the fluid tank to the at least one external overflow tank.

17. The energy generating system of claim 14, wherein a length of each of the plurality of floor tiles is within a range of 25 centimeters (cm)-50 cm, wherein a width of each of the plurality of floor tiles is within a range of 25 cm-50 cm, wherein a height of each of the plurality of floor tiles is within a range of 3 cm-10 cm.

18. The energy generating system of claim 14, wherein each of the plurality of floor tiles is modular in shape such that a smaller tile selected from the plurality of floor tiles is an equal division of a larger tile selected from the plurality of floor tiles.

19. The energy generating system of claim 14, wherein the plurality of floor tiles is layered in a soldier stacked pattern.

20. The energy generating system of claim 14, wherein an efficiency of the plurality of turbines is within a range of 80%-90%.

* * * * *